US008202107B1

(12) United States Patent
Wang et al.

(10) Patent No.: US 8,202,107 B1
(45) Date of Patent: Jun. 19, 2012

(54) PRINTED CIRCUIT BOARD CONNECTOR

(75) Inventors: Hung-Chi Wang, Taipei (TW); Mei-Chuan Yang, Taipei (TW)

(73) Assignee: Cheng Uei Precision Industry Co., Ltd., Taipei (TW)

( * ) Notice: Subject to any disclaimer, the term of this patent is extended or adjusted under 35 U.S.C. 154(b) by 67 days.

(21) Appl. No.: 12/969,979

(22) Filed: Dec. 16, 2010

(51) Int. Cl.
*H01R 13/62* (2006.01)

(52) U.S. Cl. ..... 439/328

(58) Field of Classification Search ..... 439/328, 439/326, 637, 540.1, 64, 92
See application file for complete search history.

(56) References Cited

U.S. PATENT DOCUMENTS

| | | | | |
|---|---|---|---|---|
| 6,042,411 | A * | 3/2000 | Choy | 439/328 |
| 6,164,998 | A * | 12/2000 | Poi et al. | 439/326 |
| 6,231,351 | B1 * | 5/2001 | Lin et al. | 439/64 |
| 6,517,378 | B2 * | 2/2003 | Fumikura | 439/570 |
| 7,074,067 | B2 * | 7/2006 | Yang et al. | 439/326 |
| 7,985,089 | B2 * | 7/2011 | Zhu et al. | 439/326 |
| 2005/0136724 | A1 * | 6/2005 | Lin | 439/326 |
| 2006/0094277 | A1 * | 5/2006 | Yang et al. | 439/328 |
| 2010/0003856 | A1 * | 1/2010 | Fu | 439/637 |
| 2011/0059629 | A1 * | 3/2011 | Chen | 439/64 |

* cited by examiner

*Primary Examiner* — Tulsidas C Patel
*Assistant Examiner* — Phuongchi Nguyen
(74) *Attorney, Agent, or Firm* — WPAT, P.C.; Anthony King

(57) ABSTRACT

A connector soldered to a PCB has an insulating housing of which two opposite ends recessed to form a pair of fixing recesses, terminals mounted in the insulating housing having soldering portions projected out of a bottom of the insulating housing, a latch member and a positioning member. The latch member has a base slice inserted in the fixing recess. A top of the base plate extends sideward and then is bent downward to form a folded plate apart facing the base plate to define an interval therebetween. The positioning member movably mounted to the latch member has a base slice inserted in the interval and a soldering slice perpendicularly connected at a bottom of the base slice for being soldered with the PCB. The base slice of is capable of moving up-and-down in the interval to adjust the soldering slice to be level with the soldering portions.

4 Claims, 3 Drawing Sheets

PRINTED CIRCUIT BOARD CONNECTOR

BACKGROUND OF THE INVENTION

1. Field of the Invention

The present invention relates to a connector, and more particularly to a connector capable of ensuring a steady connection between terminals thereof and a printed circuit board (PCB).

2. The Related Art

Referring to FIGS. 4-5, a conventional connector 100' has an insulating housing 10', a plurality of terminals 20' mounted in the insulating hosing 10' and each having a soldering portion 21' projecting out of a bottom of the insulating housing 10' for being soldered with a PCB, a pair of latch members 30' mounted in two opposite ends of the insulating housing 10' respectively and further projecting forward out of the insulating housing 10', and a pair of positioning members 40' mounted on fronts of the latch members 30' respectively. The positioning member 40' has a pair of soldering plates 41' and a fixing portion 42' of substantially inverted-U shape linking the two soldering plates 41'. The soldering plates 41' are soldered with the PCB so as to fix the latch member 30' with the PCB. However, it is difficult to keep the two soldering plates 41' always level with the soldering portions 21' due to the tolerance in production.

SUMMARY OF THE INVENTION

Accordingly, an object of the present invention is to provide a connector soldered with a PCB. The connector has an insulating housing, a plurality of terminals assembled in the insulating housing, a pair of latch members mounted to the two opposite ends of the insulating housing and a pair of positioning members respectively. The insulating housing has a base of which two opposite ends of a front side recessed rearward to form a pair of fixing recesses. Each of the terminals has a soldering portion projecting out of a bottom of the base for being soldered with the PCB. The latch member has a base slice. A rear of the base plate extends rearward to form a fixing plate press fitted in the fixing recess. A portion of a top edge of the base plate is bent sideward and then extending downward to form a folded plate apart facing the base plate to define an interval between the base plate and the folded plate. The base plate projects beyond the front side of the base and a rear edge of the folded plate rests against the front side of the base. The positioning member is movably mounted to the latch member. The positioning member has a base slice and a soldering slice substantially perpendicularly connected at a bottom of the base slice. The base slice is movably inserted in the interval of the latch member by means of interfering with the latch member. The soldering slice is located under the base plate of the latch member to be soldered with the PCB. So, the base slice of the positioning member is capable of moving up-and-down in the interval of the latch member for adjusting the soldering slice to be level with the soldering portions of the terminals.

As described above, the positioning member is movably mounted to the latch member with the base slice received in the interval between the base plate and the folded plate. The positioning member is capable of moving up-and-down for adjusting the soldering slice to be level with the soldering portions of the terminals. So, the connector is able to keep the soldering portions of the terminals being soldered with the PCB even when there is tolerance in production.

BRIEF DESCRIPTION OF THE DRAWINGS

The present invention will be apparent to those skilled in the art by reading the following description thereof, with reference to the attached drawings, in which.

DETAILED DESCRIPTION OF THE EMBODIMENT

Figure 1:
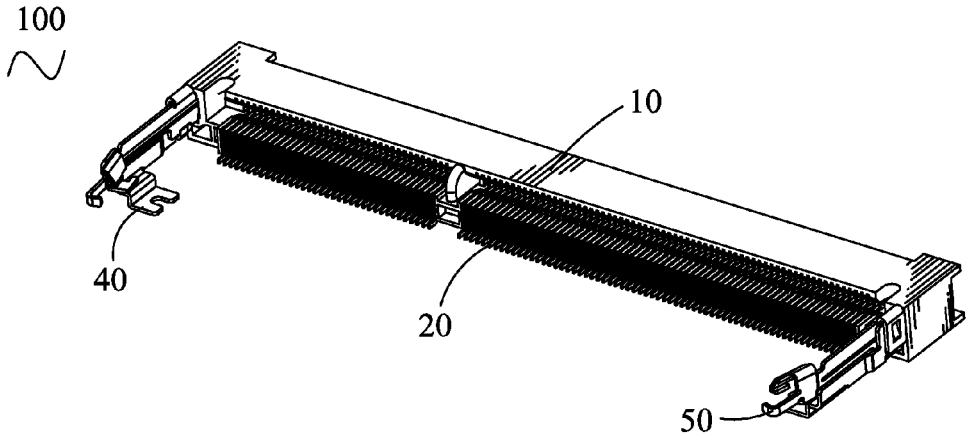
FIG. 1 is an assembled, perspective view of a connector of an embodiment in accordance with the present invention.
Figure 2:
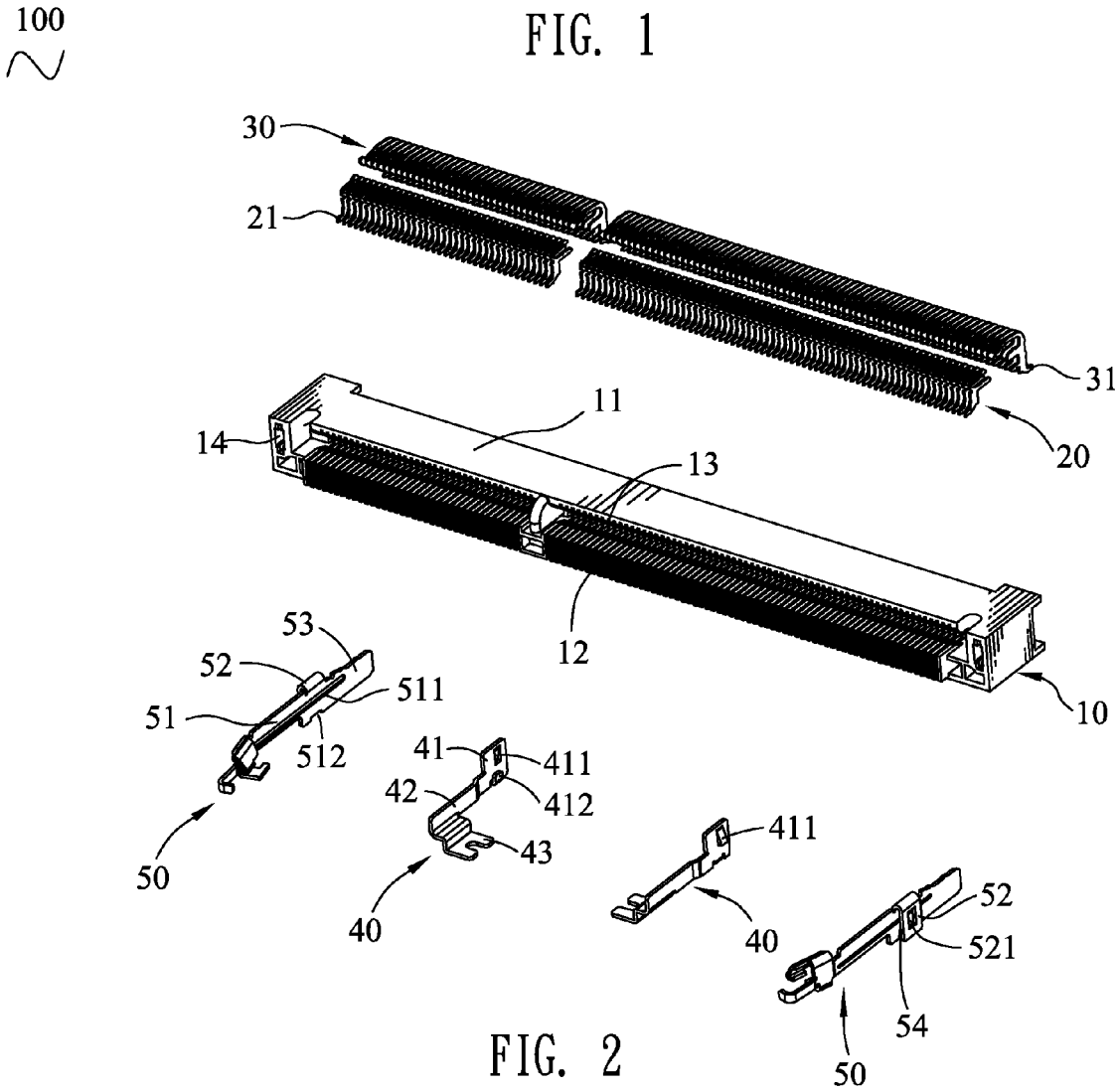
FIG. 2 is an exploded, perspective view of the connector shown in FIG. 1.

Referring to the drawings in greater detail, and first to FIGS. 1-2, the embodiment of the invention is embodied in a connector 100. The connector 100 has an insulating housing 10, a plurality of first terminals 20 and second terminals 30 mounted in the insulating housing 10, a pair of latch members 50 assembled to two opposite ends of the insulating housing 10 respectively, and a pair of positioning members 40 movably mounted to the latch members 50 respectively.

With reference to FIGS. 1-2, the insulating housing 10 has a long rectangular base 11. A lower part of a front of the base 11 defines a plurality of first terminal grooves 12 arranged at regular intervals along a longwise direction thereof. An upper portion of the base 11 defines a plurality of second terminal grooves 13 arranged at regular intervals along the longwise direction thereof. Each of two opposite ends of a front of the base 11 is recessed rearward to form a fixing recess 14.

The first terminals 20 are disposed in the corresponding first terminal grooves 12, and each has a first soldering portion 21 projecting out of a bottom of the base 11 for being soldered with a PCB (not shown). The second terminals 30 are respectively disposed in the second terminal grooves 13, and each has a second soldering portion 31 projecting out of the bottom of the base 11 for being soldered with the PCB.

The latch member 50 has a long rectangular base plate 51. A middle portion of the base plate 51 is punched to form a reinforcing rib 511 extending along the extension direction of the base plate 51 and crossing the whole base plate 51. A rear edge of the base plate 51 extends rearward to form a fixing plate 53. The fixing plate 53 is press fitted in the fixing recess 14 of the base 11 with the base plate 51 projecting out of the front of the base 11. A portion of a top edge of the base plate 51 adjacent to the fixing plate 53 extends sideward and then is bent downward to form a folded plate 52 apart facing the base plate 51 to define an interval 54 between the base plate 51 and the folded plate 52. A substantially middle portion of the folded plate 52 defines a rectangular opening 521 communicating with the interval 54. A portion of a bottom of the base plate 51 is recessed upward to form a notch 512 facing a bottom of the folded plate 52 and communicating with the interval 54. The folded plate 52 rests against the front of the base 11 for preventing the latch member 50 further going into the fixing recess 14 when the latch member 50 is assembled to the base 11.

Figure 3:
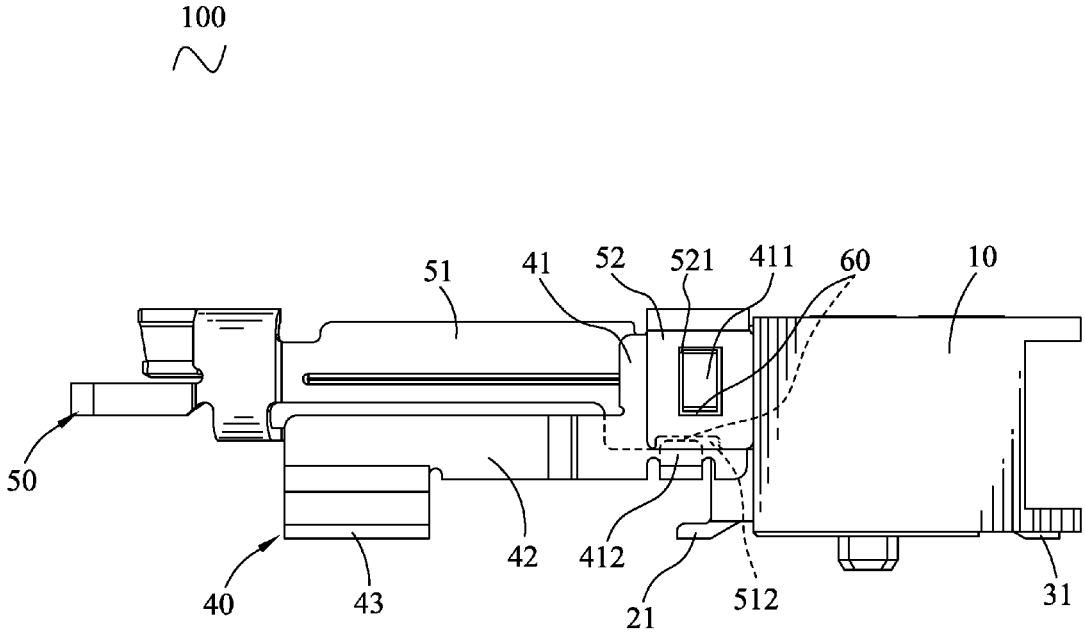
FIG. 3 is an assembled, lateral view of the connector shown in FIG. 1.
Figure 4:
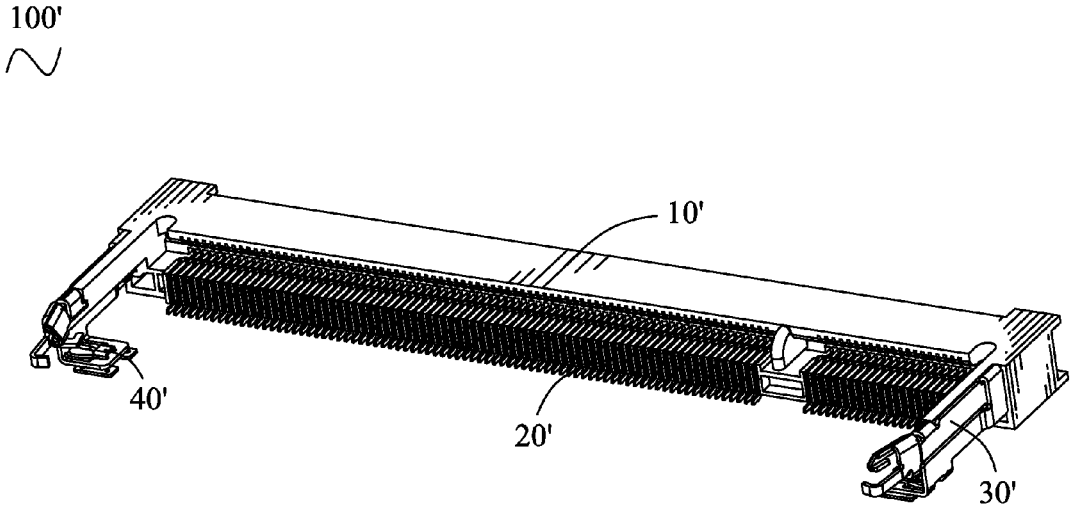
FIG. 4 (Prior Art)
FIG. 4 is an assembled, perspective view of a conventional connector.
Figure 5:
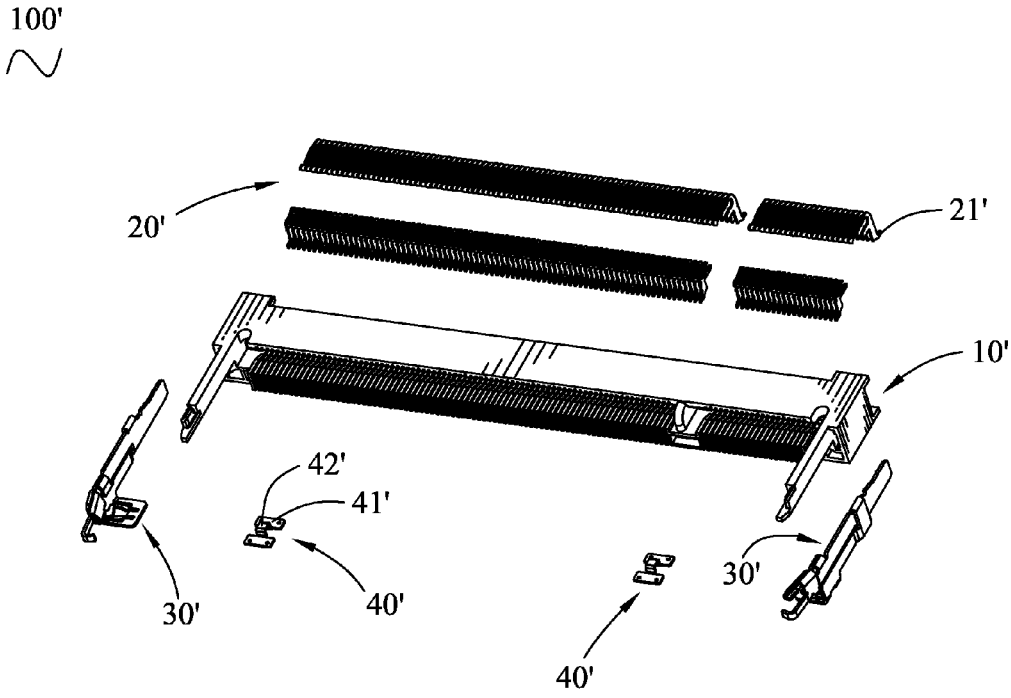
FIG. 5 (Prior Art)
FIG. 5 is an exploded, perspective view of the conventional connector shown in FIG. 4.

Referring to FIGS. 2-3, the positioning member 40 has a rectangular base slice 41 placed vertically. An upper portion of the base slice 41 is punched toward the same direction as the folded plate 52 to form a projection 411 slanting outward from top to bottom. A lower portion of the base slice 41 protrudes oppositely to the projection 411 to form a protrusion 412. A bottom of a front edge of the base slice 41 extends frontward to form a long rectangular connecting slice 42. A bottom of a front of the connecting slice 42 is punched perpendicularly toward the same direction as the protrusion 412 to form a soldering slice 43. In assembly, the base slice 41 is movably inserted in the interval 54 by means of the projection 411 buckled with the opening 521 for preventing the positioning member 40 falling off the latch member 50. Meanwhile, the protrusion 412 can be received in the notch 512 for preventing the positioning member 40 further going into the interval 54. The connecting slice 42 stretches forward beyond the interval 54 and is located against a lower outside of the base plate 51 of the latch member 50. The soldering slice 43 is located under the base plate 51 to be soldered with the PCB. When the protrusion 412 is completely buckled in the notch 512, there is a gap 60 formed between a bottom of the projection 411 and a bottom of the opening 521, so the positioning member 40 is capable of moving downward for a certain distance. When the positioning member 40 slides downward till the projection 411 is blocked against the bottom of the opening 521, there is a gap 60 formed between a top of the protrusion 412 and a top of the notch 512, so the positioning member 40 is capable of moving upward for a certain distance. So, the positioning member 40 is capable of moving up-and-down to adjust a relative position of the soldering slice 43 of the positioning member 40 so as to keep the soldering slices 43 level with the soldering portions 21, 31 of the terminals 20, 30.

As described above, the positioning member 40 is movably mounted to the latch member 50 with the base slice 41 received in the interval 54 between the base plate 51 and the folded plate 52 by means of the projection 411 engaged with the opening 521 and the protrusion 412 engaged with the notch 512. As the gap 60 is always formed between the bottom of the projection 411 and the bottom of the opening 521, or between the top of the protrusion 412 and the top of the notch 512, the positioning member 40 is capable of moving up-and-down for adjusting the relative position of the soldering slice 43 to keep the soldering slice 43 level with the soldering portions 21, 31 of the terminals 20, 30. So, the connector 100 is able to keep the soldering portions 21, 31 of the terminals 20, 30 being soldered with the PCB even when there is tolerance in production.

What is claimed is:

1. A connector soldered to a PCB, comprising:

an insulating housing having a base of which two opposite ends of a front side being recessed rearward to form a pair of fixing recesses;

a plurality of terminals assembled in the base of the insulating housing, each of the terminals having a soldering portion projecting out of a bottom of the base for being soldered with the PCB;

a latch member mounted to the insulating housing and having a base plate, a rear of the base plate extending rearward to form a fixing plate press fitted in the fixing recess, a portion of a top edge of the base plate being bent sideward and then extending downward to form a folded plate apart facing the base plate to define an interval between the base plate and the folded plate, the base plate projecting beyond the front side of the base and a rear edge of the folded plate resting against the front side of the base; and a positioning member movably mounted to the latch member, the positioning member having a base slice and a soldering slice substantially perpendicularly connected at a bottom of the base slice, the base slice being movably inserted in the interval of the latch member by means of interfering with the latch member, the soldering slice being located under the base plate of the latch member to be soldered with the PCB, wherein the base slice of the positioning member is capable of moving up-and-down in the interval of the latch member for adjusting the soldering slice to keep the soldering slice level with the soldering portions of the terminals;

wherein a lower portion of the base slice protrudes towards the base plate to form a protrusion, a bottom of the base plate is recessed upward to form a notch facing the folded plate for receiving the protrusion therein to prevent the base slice further going upward into the interval.

2. The connector as claimed in claim 1, wherein an upper portion of the base slice protrudes towards the folded plate to form a projection slanting outward from top to bottom, a substantially middle portion of the folded plate defines an opening having a slightly bigger height than that of the projection to receive the projection therein.

3. The connector as claimed in claim 1, wherein a bottom of a front edge of the base slice extends frontward to form a long rectangular connecting slice projecting forward out of the interval and located against a lower outside of the base plate, the soldering slice is formed by substantially perpendicularly extending sideward from a bottom of a front of the connecting slice.

4. The connector as claimed in claim 1, wherein a substantially middle portion of the base plate is punched outward to form a reinforcing rib extending along the extension direction of the base plate and crossing the whole base plate.

* * * * *